US005833900A

United States Patent [19]

Franke et al.

[11] Patent Number: 5,833,900

[45] Date of Patent: Nov. 10, 1998

[54] PROCESS FOR MODIFYING POROSITY IN SHEET MADE FROM FLASH SPINNING OLEFIN POLYMER

[75] Inventors: Ralph A. Franke, Richmond; Hyun S. Lim; Larry Ray Marshall, both of Chesterfield, all of Va.

[73] Assignee: E. I. du Pont de Nemours and Company, Wilmington, Del.

[21] Appl. No.: 685,368

[22] Filed: Jul. 23, 1996

Related U.S. Application Data

[60] Provisional application No. 60/001,626 Jul. 28, 1995.

[51] Int. Cl.[6] ..... D01D 5/11

[52] U.S. Cl. ..... 264/103; 264/205; 264/211.12; 425/382.2; 425/464

[58] Field of Search ..... 264/103, 205, 264/211.12; 425/382.2, 464

[56] References Cited

U.S. PATENT DOCUMENTS

| | | | |
|---|---|---|---|
| 3,081,519 | 3/1963 | Blades et al. | 57/248 |
| 3,169,899 | 2/1965 | Steuber | 428/198 |
| 3,227,784 | 1/1966 | Blades et al. | 264/53 |
| 3,227,794 | 1/1966 | Anderson et al. | 264/205 |
| 3,484,899 | 12/1969 | Smith | 425/171 |
| 3,756,441 | 9/1973 | Anderson et al. | 264/205 |
| 3,851,023 | 11/1974 | Brethauer et al. | 264/441 |
| 5,123,983 | 6/1992 | Marshall | 156/167 |
| 5,147,586 | 9/1992 | Shin et al. | 264/13 |
| 5,286,422 | 2/1994 | Kato et al. | 264/205 X |

*Primary Examiner*—Leo B. Tentoni

[57] ABSTRACT

This invention relates to a system and process for modifying the resulting properties of a flash spun plexifilamentary film-fibril web and spunbonded nonwoven sheets made from such webs. In particular, the system includes specifically designed letdown chamber arrangements wherein the solution of polymer and spin agent transitions from a single phase solution to a two phase solution in the letdown chamber prior to spinning at the spin orifice. The method comprises altering the configuration of the letdown chamber to alter the properties of the web and the sheet products made therefrom.

13 Claims, 10 Drawing Sheets

PROCESS FOR MODIFYING POROSITY IN SHEET MADE FROM FLASH SPINNING OLEFIN POLYMER

This application claims the benefit of U.S. Provisional Application No. 60/001,626, filed Jul. 28, 1995.

FIELD OF THE INVENTION

This invention relates to flash spinning olefin polymers and more particularly to the process of making sheets by flash spinning and bonding olefin polymer.

BACKGROUND OF THE INVENTION

In the process of making TYVEK® spunbonded olefin, E. I. du Pont de Nemours and Company (DuPont) forms a single phase solution of ethylene polymer and spin agent at high temperature and pressure. The single phase solution is directed into a letdown chamber to form a two phase solution wherein one phase is a polymer rich phase and the other is a spin agent rich phase. Immediately from the letdown chamber the solution is directed through a spin orifice into a region of much lower pressure and temperature such that the spin agent is flash evaporated and a fibrillated strand of plexifilamentary material is formed.

As is described in many DuPont patents, the process thereafter includes flattening the strand into a web and directing the web in an oscillating pattern back and forth across a conveyor. Other strands are spun at adjacent stations or spin packs which overlap to form an unbonded sheet of the plexifilamentary film-fibril webs. The sheet is typically consolidated on the conveyor belt and later provided with other finishing steps that make the sheet material particularly useful for a variety of applications. US Pat. No. 3,081,519 to Blades et al., 3,227,784 to Blades et al., 3,169,899 to Steuber, 3,227,794 to Anderson et al., 3,851,023 to Brethauer et al., 5,123,983 to Marshall, and U.S. patent application Ser. No. 08/367,367describe numerous aspects of the process for making such material and are incorporated by reference herein.

As may be noted in the process of making TYVEK® is that it is currently made with a CFC spin agent. As the use of CFC materials will be prohibited, DuPont has revamped the process of manufacture to eliminate CFC's from the process. However, this has proven to be a daunting task. Presently, DuPont is developing a manufacturing process that utilizes normal pentane hydrocarbon as the spin agent. During developmental tests, it was found that the porosity of sheet material made in the test facility was much more porous than material made with the conventional spin agent. As there are a number of applications for TYVEK® which are best served by the conventional porosity, the system must be altered to provide less porous sheet product.

Accordingly, it is an object of the present invention to overcome the above noted problems to provide a sheet product having the desired properties and characteristics.

It is another object of the present invention to provide a process and system that has the ability to modify or vary the properties and characteristics of the sheet material.

SUMMARY OF THE INVENTION

The foregoing objects are achieved by a process for manufacturing spunbonded olefin sheets made of layers of flash spun plexifilamentary film-fibril webs. The process comprises forming a single phase solution of olefin polymer with spin agent at high pressure and temperature and then lowering the pressure of the solution in at least one letdown chamber to form a two phase solution. The two phase solution is then passed through a plurality of spin orifices to flash evaporate the spin agent and form plexifilamentary film-fibril webs. The film-fibril webs are overlaid on a conveyor to form nonwoven sheet material having properties in a predetermined range. The process particularly includes the step of inducing a higher scale of recirculation in the letdown chamber.

Inducing a higher scale of recirculation in the letdown chamber may be accomplished in by a variety of techniques including providing inserts which reduce the length of the letdown chamber, inserts which change the deceleration angle in the letdown chamber, a letdown chamber with a length to diameter ratio of less than about six to one, and other geometric alterations or flow altering inserts which widen the range of residence times for the solution passing through the letdown chamber.

BRIEF DESCRIPTION OF THE DRAWINGS

The invention will be more easily understood by a detailed explanation of the invention. Accordingly, such drawings are attached herewith and are briefly described as follows.

DETAILED DESCRIPTION OF THE EMBODIMENT

Figure 1:
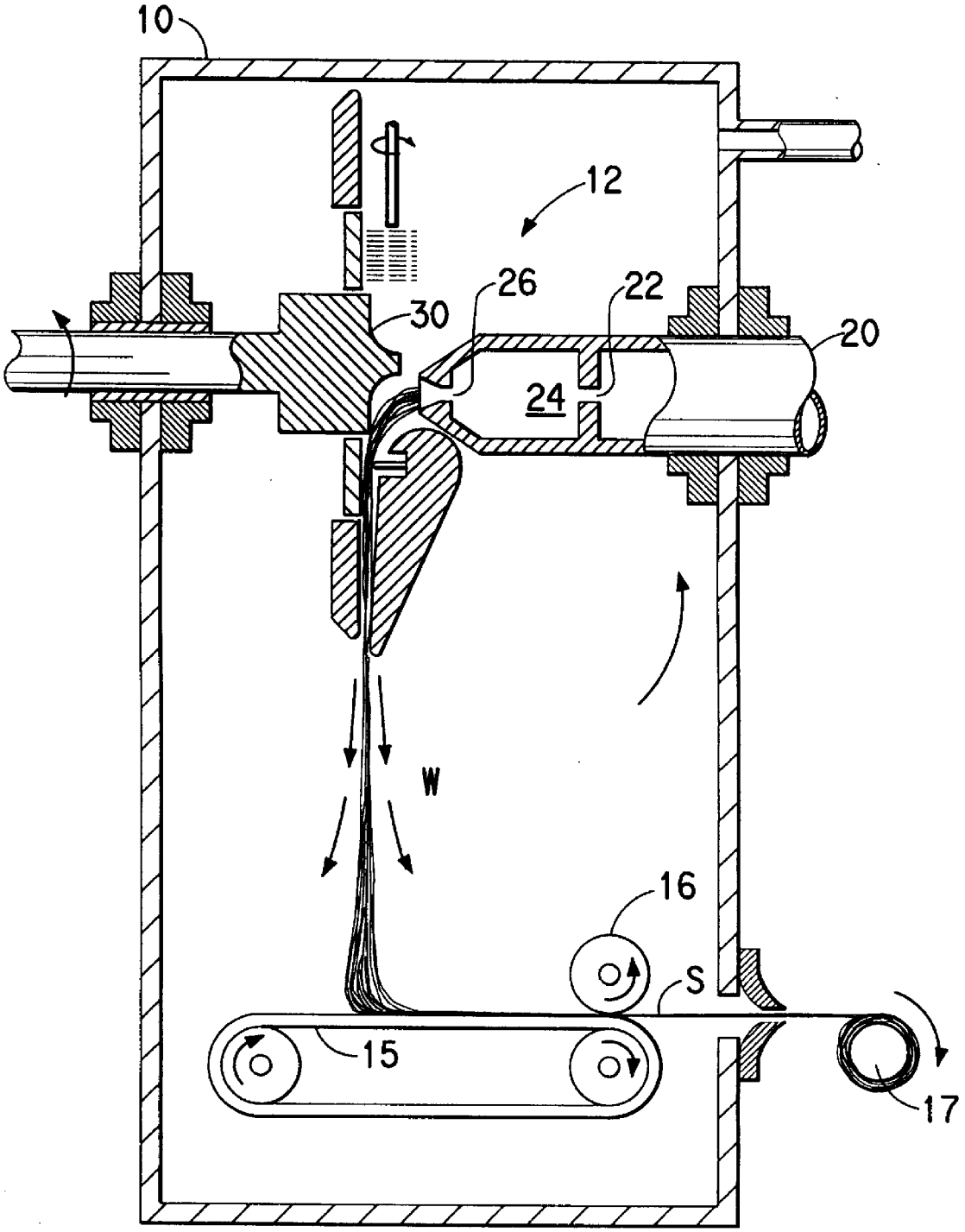
FIG. 1 is a generally schematic cross sectional horizontal elevational view of a single spin pack within a spin cell illustrating the formation of a sheet product.

Referring now to the drawings, there is illustrated a spin cell 10 in which a fiber web W is flash spun and formed into a sheet S. The illustration of the spin cell 10 is quite schematic and fragmentary for purposes of explanation. A schematically illustrated spin pack, generally indicated by the number 12, is positioned within the spin cell 10 in the process of spinning the fiber web W. It should be understood that the process of manufacturing TYVEK® sheet material includes the use of a number of additional spin packs similar to spin pack 12 which are arranged in the spin cell 10 spinning and laying down other webs W to be overlapped together.

The spin pack 12 spins the web from a polymer solution which is provided to the spin pack 12 through a conduit 20. The polymer solution is provided at high temperature and pressure so as to be a single phase solution. The polymer solution is then admitted through a letdown orifice 22 into a letdown chamber 24. There is a pressure drop through the letdown orifice 22 so that the solution experiences a slightly lower pressure. At this lower pressure, the single phase solution becomes a two phase solution. A first phase of the two phase solution has a relatively higher concentration of polymer as compared to the polymer concentration of the second phase which has a relatively lower concentration of polymer. The system operates such that percentage of polymer in the solution is between slightly less than ten percent up to in excess of twenty five percent based on weight and depending on the spin agent. Thus, the polymer rich phase probably still has more spin agent than polymer on a comparative weight basis. Based on observations, the polymer rich phase appears to be the continuous phase.

From the letdown chamber 24, the two phase polymer solution exits through a spin orifice 26 and enters the spin cell 10 which is at much lower temperature and pressure. At such a low pressure and temperature, the spin agent evaporates or flashes from the polymer such that the polymer is immediately formed into a plexifilamentary film-fibril web. The web W exits the spin orifice 26 at very high velocity and is flattened by impacting a baffle 30. The baffle 30 further redirects the flattened web along a path that is roughly 90 degrees relative to the axis of the spin orifice (generally downwardly in the drawing). The baffle 30, as described in other DuPont patents such as those noted above, rotates at high speed and has a surface contour to cause the web W to oscillate in a back and forth motion in the widthwise direction of the conveyor belt 15.

Figure 12:
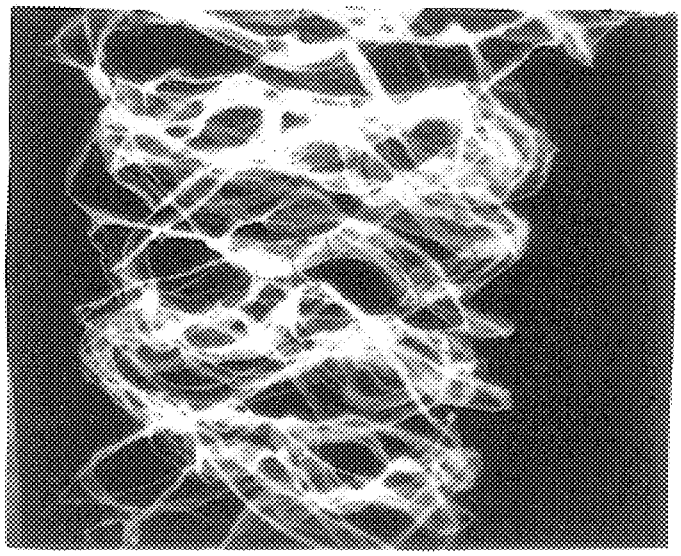
FIG. 12 is a top view photographic image of a single web swath as laid down by a single spin pack onto a moving conveyor belt.

It would be ideal if each web W would form a generally sinusoidal patterned swath, broadly covering the belt; however, in actual practice, there is a substantial randomness to the pattern in which the web becomes arranged on the conveyor belt 15. There are many dynamic forces on the web, in addition to the turbulence in the spin cell, that effectively cause the webs to "dance" on the conveyor belt. In addition, the webs tend to collapse, at times, from a spread apart "spider web" like netting of approximately 1 to 8 or more inches in width, into a yarn like strand of less than an inch. Thus, there are portions in the pattern that are broadly opened up generously covering the belt, while other portions cover only a thin strip of the conveyor belt. As seen in FIG. 12, the swath formed by a single web includes many holes or portions which are not filled in. The example in FIG. 12 was run at 300 yards per minute which is near the upper portion of the speed range. The range is broadly about 25 to 500 or more yards per minute. From FIG. 12, it should be clear that the laydown includes some overlay of the web swath onto itself with some open portions distributed throughout the swath. However, at slower belt speeds, the swath is better filled in.

As noted above, the sheet material is formed from the webs of a number of spin packs. Thus, the web swaths overlap web swaths of numerous other spin packs, depending on the speed of the web impacting the baffle 30 and the rotation speed of the baffle. The rotation speed of the baffle 30 preferably results in a complete oscillation of the web being formed at the rate of generally between 60 to 150 cycles per second and the web swaths end up being about one to three feet wide. The spin packs are preferably arranged in a staggered configuration along the conveyor direction (or machine direction) so that each spin pack may be laterally offset (widthwise to the belt) in the range of less than an inch up to about five inches from the next closest spin pack. Clearly, the sheet product S will be formed of many overlapping web swaths.

At the end of the spin cell 10, the sheet has the form of a batt of fibers very loosely attached together. The batt is run under a nip roller 16 to consolidate it into the sheet product S and it is then wound up on roll 17. The sheet product S is then taken to a finishing facility where it may be subjected to an assortment of processes depending on the end use of the material. Most TYVEK® sheet end uses are for fully bonded sheet goods. Most people come into contact with fully bonded TYVEK® sheet with envelopes and housewrap. Fully bonded sheet is formed from the sheet product S by pressing it on heated rolls. The heat is maintained at a predetermined temperature (depending on the desired characteristics of the final sheet product) such that the web bonds together under the pressure to form a sheet that has substantial strength and toughness while maintaining its opaque quality. For example, TYVEK® sheet is noted for its tear strength and tensile strength. DuPont also measures delamination strength, burst strength, hydrostatic head, breaking strength, and elongation of its many styles of TYVEK® sheet. Unfortunately, in order to obtain certain qualities other qualities end up being compromised. For example, delamination strength is improved by higher bonding temperatures so that the middle portion of the sheet becomes fully heated and therefore, more fully bonded to the surface regions of the sheet. However, heat tends to shrink the highly oriented molecular structure of the fibrils and the surface area of the fibrils is reduced. Lower surface area reduces the opacity and the TYVEK® sheet becomes more translucent.

As noted above, there are many characteristics of TYVEK® sheet that DuPont investigates, monitors and is otherwise interested in continually optimizing for various end use requirements and purposes. For example, the barrier properties of fully bonded sheet are important in many applications, so porosity is measured by the Gurley Hill method. In many years of experience with the CFC spin agent and the recent intensive investigation related to the commercialization of a new spin agent, DuPont engineers have noted that when the webs formed in the spinning process are very fine having lots of fibrils, the Gurley Hill Porosity goes up (meaning that the sheet is less porous). This is consistent with nonwoven sheets made using other technology such as sheets made from spunbonded and melt blown fibers. In addition, Darcy's law provides scientific prediction of the porosity of fabrics based on the diameter of the fibers in the fabric. Darcy's law is very complicated and would be difficult to explain in this patent, but suffice it to say that Darcy's law also predicts that the smaller the fibers, the smaller the pores and the less porous the sheet. Thus, the porosity decreases with finer fiber size as one would expect.

With experiments run in anticipation of making TYVEK® sheet material with a new spin agent, the Gurley Hill Porosity Values were found to be lower than desired for certain end use products. It has been the experience of those in DuPont that one method of obtaining higher Gurley Hill is to seek smaller fibril size. Fibril size of the original webs were quite comparable to the CFC system and it was believed that it would take a rather well fibrillated web (comprising many, many fibrils of finer size and more tie points). Numbers of tests were run testing a great array of possible conditions for the system. Other tests were run changing parameters which were previously unexplored.

One of the modified conditions was the length of the letdown chamber. It was found that if the length of the letdown chamber were reduced while maintaining its standard diameter, a web having what appear to be fewer and larger fibrils was produced. The webs included portions which may be characterized as "bunched fibrils". The bunched fibrils at times appeared to be large fibrils and at other times appeared to be comprised of conventional sized fibrils with extremely short tie points preventing the bunched fibrils from being opened up by hand to reveal any type of verifiable fibrillation or characterization. In accordance to conventional wisdom within the company, such webs would have been expected to have even lower Gurley Hill Porosity Values than was produced in the original configuration. Little attention was given to such poor appearing webs. However, for completeness, the poorly fibrillated webs were bonded for testing.

Surprisingly, it was found that the Gurley Hill Porosity Value of the sheet made from the poorly fibrillated webs was considerably higher. Upon this discovery, further tests and experiments have been run to better understand the unexpected phenomenon and more importantly to obtain optimum sheets products for manufacture and sale from the new process.

As described above, the invention relates in part to adjusting the Gurley Hill Porosity Value by modifying the configuration of the letdown chamber. However, designing a system for adjusting the length of the letdown chamber in a small piece of equipment that operates at high pressure and temperature in a cost effective manner is no simple task. The problem has been solved in the present invention by the creation of a set or assortment of inserts which are provided into the spin block. Some of the letdown orifices include arrangements to accommodate the letdown orifice and, in particular, to position the letdown orifice in such a place as to change the length of the letdown chamber 24.

Figure 2:
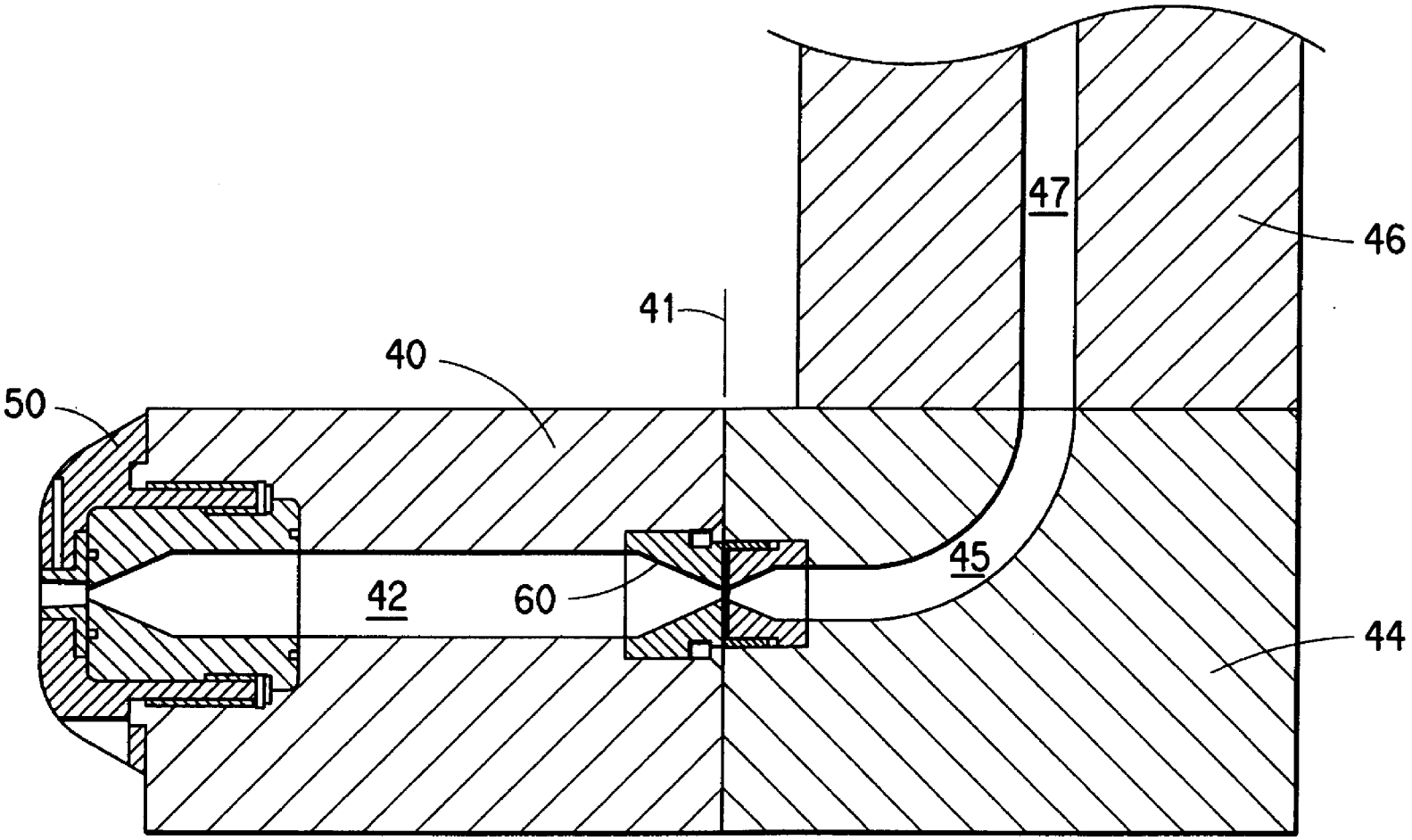
FIG. 2 is an enlarged cross sectional view of the block within the spin pack illustrating the path of the polymer solution into and through the letdown chamber.

Referring specifically to FIG. 2, the spin block 40 includes a tubular passageway 42. Attached at the left end thereof is a spin orifice assembly, generally indicated by the number 50, which is attached to the spin block 40 by screw threads, bolts or other suitable means. Adjacent the other end of the spin block 40 is a connector block 44 which has a curved tubular passageway 45 arranged to align with the tubular passageway 42 of the spin block 40 for the passage of polymer solution immediately prior to being spun into the plexifilamentary film-fibril web as described above. A down leg connector 46 is arranged to be connected on the upper portion of connector block 44 and includes a passage 47 which is similarly aligned with curved tubular passageway 45.

Figure 5:
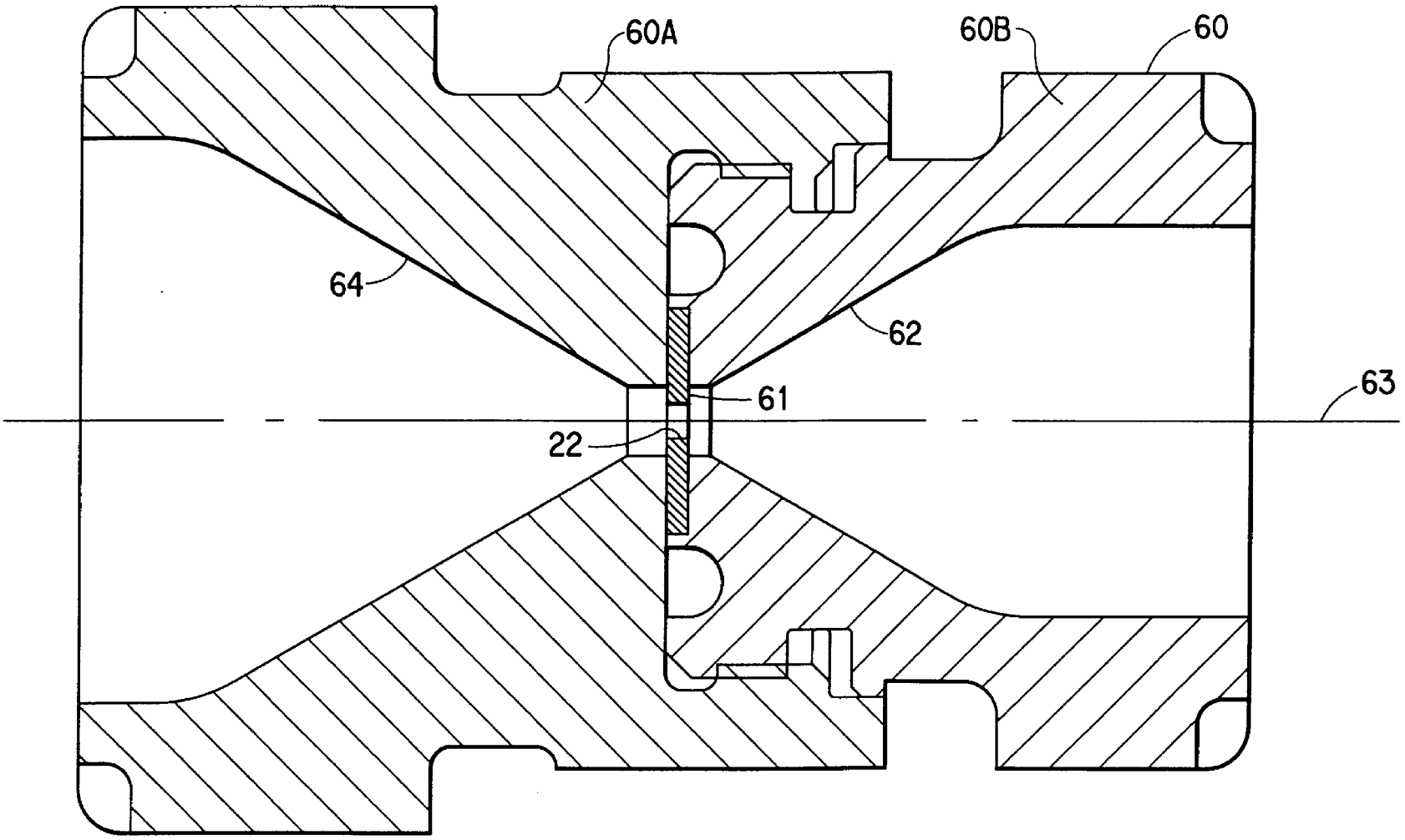
FIG. 5 is an enlarged cross sectional view of the letdown insert, nominally called a "full" letdown insert, in FIG. 2.

Referring now to both FIG. 2 and 5, a letdown insert 60 is provided at the interface of spin block 40 and connector block 44 within the respective passageways 42 and 45 thereof. The letdown insert 60 includes a letdown orifice plate 61 (best seen in FIG. 5) having a letdown orifice 22 therein. The letdown orifice plate 61 is preferably oriented with or near the interface plane 41 where the spin block 40 and connector block 44 abut. The letdown insert 60 comprises two parts 60A and 60B which are attached by screw threads or other suitable means. The letdown orifice plate 61 preferably sits in a recess in one of the insert parts 60A or 60B and is held in the recess by the other insert part. The letdown orifice plate 61 is presently made of 430 stainless steel, but may also be made of other hard and tough materials including other stainless steels or other suitable metals, tungsten carbide and other ceramics. A tungsten carbide letdown orifice plate is believed to eventually be the preferred arrangement.

On either side of the letdown orifice plate 61, the insert 60 includes a tapered wall portion to gradually accelerate the polymer solution through the orifice 22 and decelerate the polymer in the letdown chamber. The letdown acceleration wall 62 preferably includes a convergence angle of about 30° with respect to the axis 63 of the insert 60 although an angle in the range of about 15° to about 90° may adequately provide a suitable results for the system. It should be recognized that the angles of the taper should be taken in general or approximate or average terms as the configuration may, in fact, become much more complex such as a continuous curve, a series of successive tapers or curves or some other shape to obtain essentially the same result. In a manner similar to the letdown acceleration wall 62, there is a letdown deceleration wall 64 which is similarly tapered. Letdown deceleration wall 64 may actually comprise a combination of geometries for the surface in a manner similar to that described above for the acceleration wall 62, and an expression of an angle relative to the axis 63 is intended to cover a number of geometries that substantially approximate the tapered geometry as shown either by appearance or by physical action on the solution moving through the letdown chamber.

Figure 10:
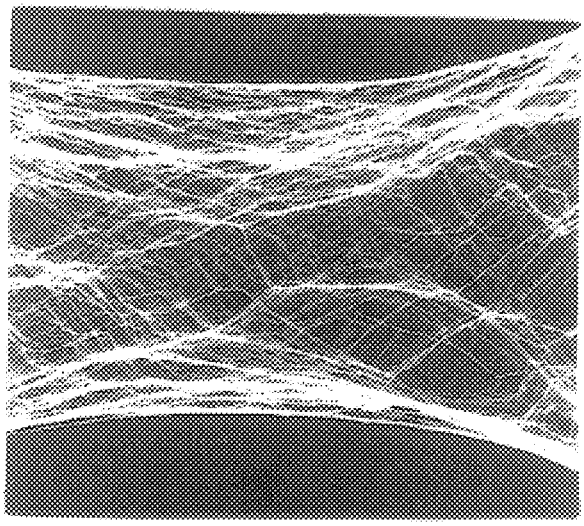
FIG. 10 is a photographic image of a web produced by a spin pack having a two thirds down insert therein as shown in FIGS. 3 and 6.
Figure 11:
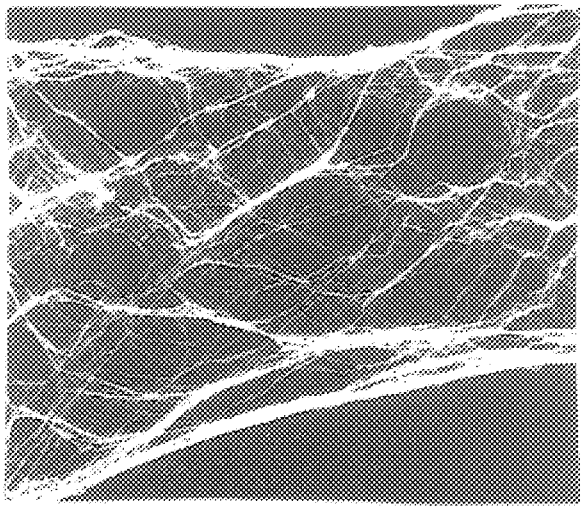
FIG. 11 is a photographic image of a web produced by a spin pack having a one half insert therein as shown in FIGS. 4 and 7.

For purposes of further discussion, the letdown chamber 24 is generally defined as that portion of passageway 42 from the interior surface of the letdown orifice plate 61 to the interior surface of the spin orifice plate 51 which includes the spin orifice 26 therein (see FIG. 10). Thus, for the arrangement in FIGS. 2 and 5, the letdown chamber 24 is a full length letdown chamber. In the examples in FIGS. 3, 4, 6, and 7, the letdown chamber is less than full length letdown chamber.

Figure 3:
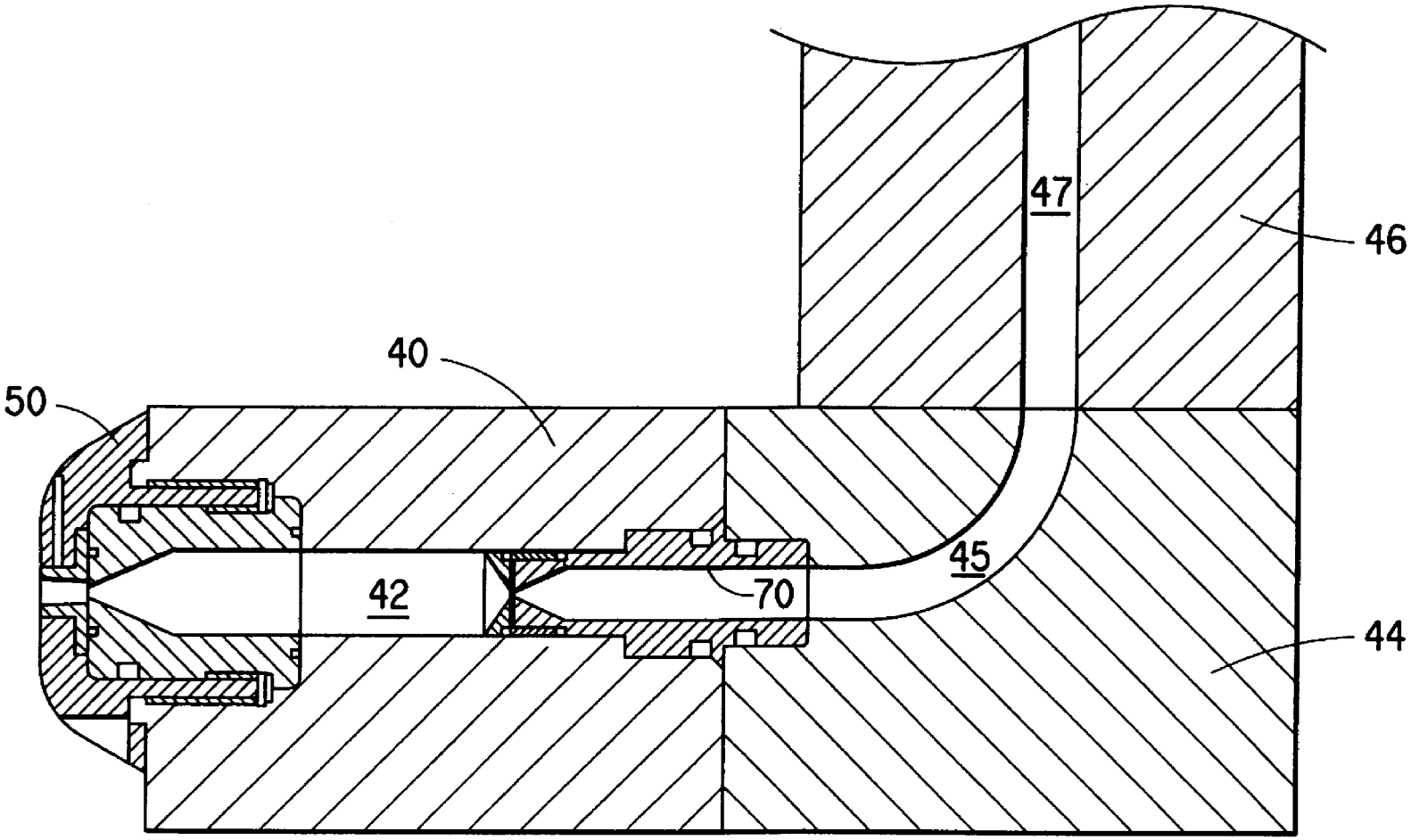
FIG. 3 a view similar to FIG. 2 wherein a different sized letdown insert, nominally called a "two thirds" letdown insert, is positioned in the block to provide a different configuration for the letdown chamber.
Figure 6:
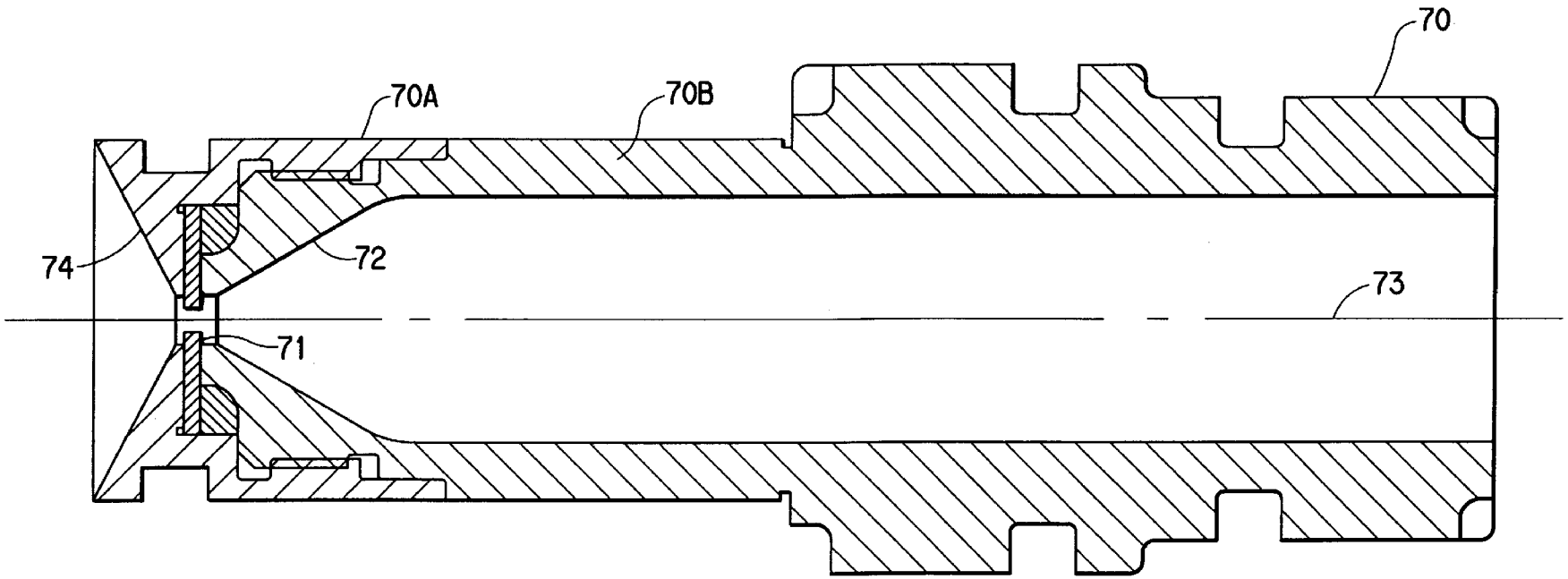
FIG. 6 is a view similar to FIG. 5 of the two thirds letdown insert illustrated in FIG. 3.

Referring now to FIGS. 3 and 6, it should be noted that the insert 70 is in the spin block 40 replacing the insert 60. Insert 70 is considerably longer than insert 60 and most notably, has the letdown orifice plate 71 in a position considerably closer to the spin orifice plate 51. Thus, the letdown chamber with the insert 70 is considerably shorter in length than the full length letdown chamber. The letdown chamber in this configuration is about two thirds the length of the full letdown chamber. For short hand sake and clarity, the insert 60 will hereafter be referred to as the full insert. Similarly, the insert 70 will hereafter be referred to as the two thirds insert.

Continuing on with the description of the two thirds insert 70, and the resulting configuration of the internals of the spin pack 12, the two thirds insert has a more dramatic taper angle for the deceleration wall 74 as compared to the deceleration wall 64 of the full insert 60. The deceleration wall 74 of the two thirds insert 70 is approximately 60° relative to the axis 73 or more preferably in the range of about 50° to about 75°. However, it is believed that wide angles are likely to produce favorable sheet properties and that angles up to and exceeding 90° may be suitable. For example, an orifice plate resembling a hypodermic needle and having an effective angle of 180° may likely produce effects similar to those obtained by reducing the length of the letdown chamber. At the other end of the spectrum, the angle may be arranged as small as mechanically possible given the length and diameter of the letdown chamber rendering a lower limit of approximately five degrees given the conventional dimensions used by DuPont.

Figure 4:
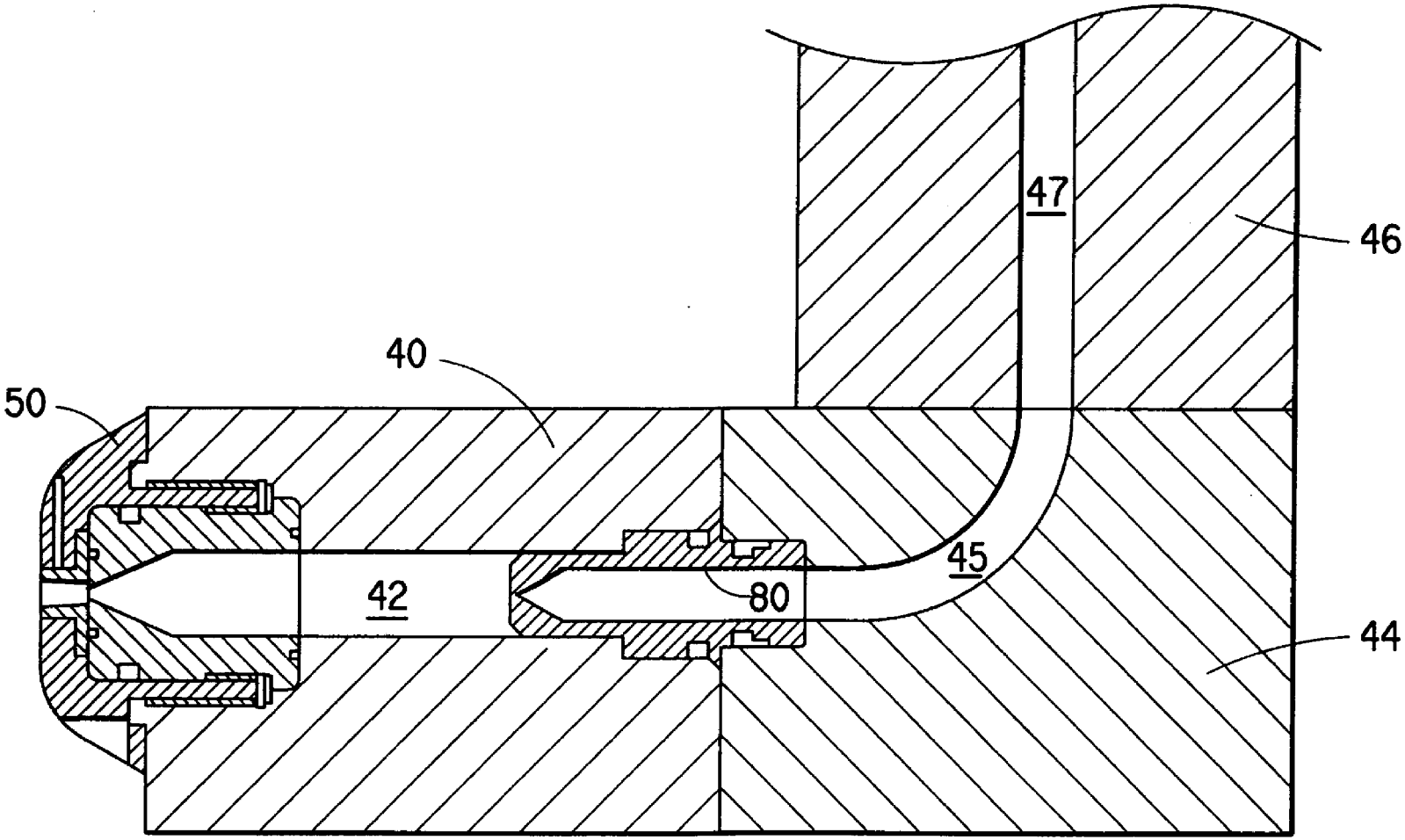
FIG. 4 is a view similar to FIG. 3 wherein a second different sized letdown insert, nominally called a "one half" letdown insert, is positioned in the block to provide a third different configuration for the letdown chamber.
Figure 7:
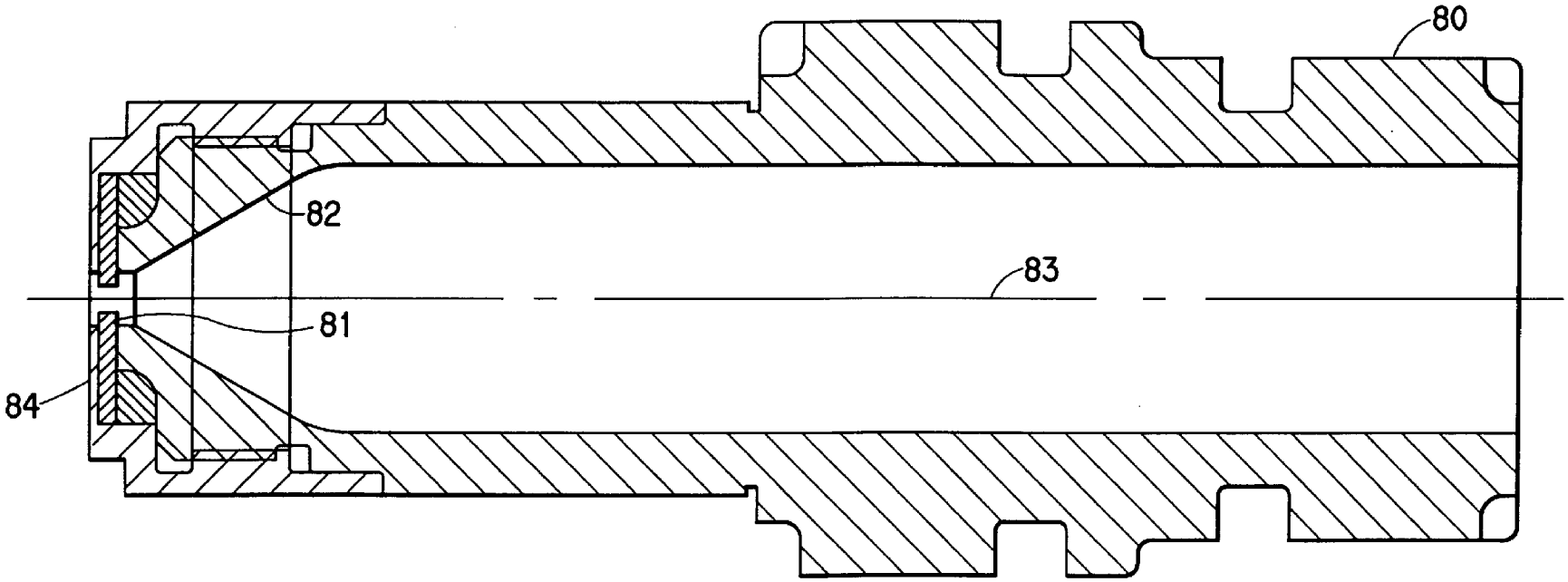
FIG. 7 is a view similar to FIG. 5 of the one half letdown insert illustrated in FIG. 4.
Figure 8:
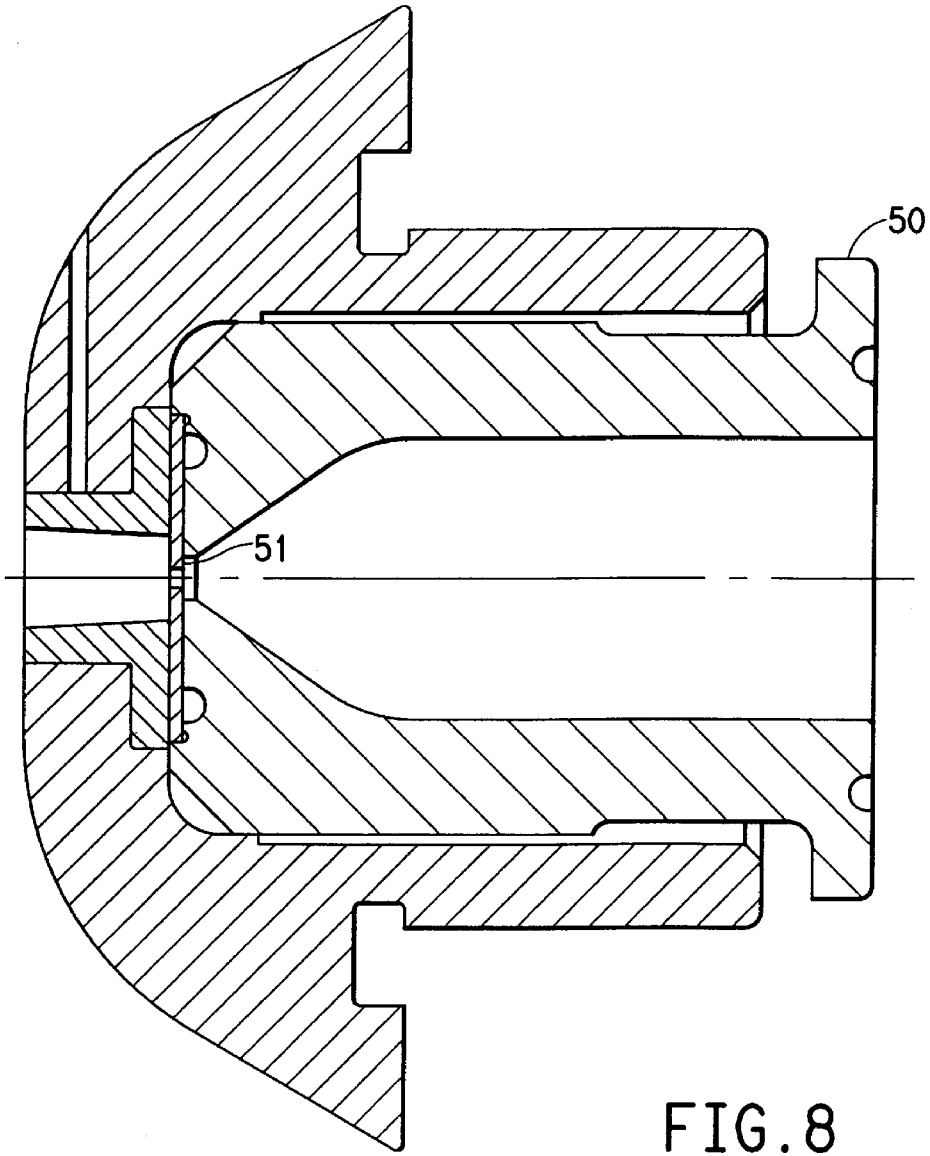
FIG. 8 is a cross sectional view of the end fitting of the spin block.
Figure 9:
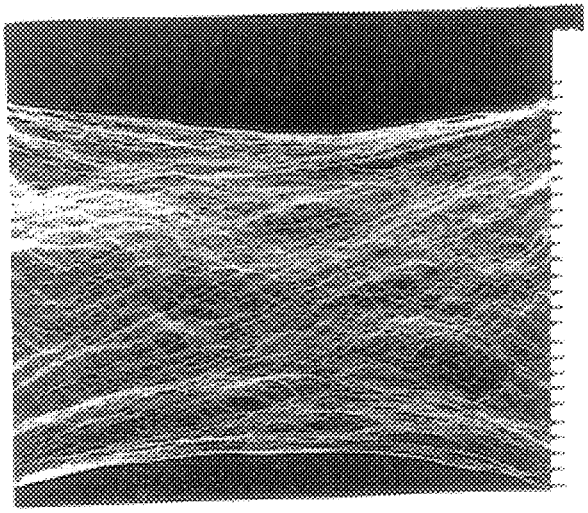
FIG. 9 is a photographic image of a web produced by a spin pack having a full letdown insert therein as shown in FIGS. 2 and 5.

Turning now to FIGS. 4 and 7, there is illustrated the one half insert 80 which, like the two thirds insert 70, reduces the effective length of the letdown chamber. The one half insert 80 also includes a deceleration wall 84 which is planar or approximately 90° to the axis 83. Alternative forms of the one half insert may include various angles of the deceleration wall similar to the two thirds letdown configuration described above.

Another factor affecting Gurley Hill Porosity Values for sheet products is the number of layers that are included in the sheet. The affects of the numbers of layers was not appreciated until experiments were run to ascertain the cumulative affects of the layers of webs. For this discussion, it is important that a number of terms be clearly understood. The term "web" has been used and intended to mean a continuous strand of a f plexifilament emanating from a single spin orifice. The term "swath" or "web swath" is intended to mean the web in an arrangement such as formed when the web has been laid onto a moving conveyor belt or similar device in a back and forth pattern widthwise relative to the conveyor belt. A "sweep" of a web is a portion of the web swath that extends general extreme of the back and forth pattern to the other side. A return "sweep" is a sweep that extends back across the web swath in the opposite direction. Thus, it takes two "sweeps" to form a complete cycle of the oscillating pattern of the web swath.

Continuing with the construction of the sheet, it must be understood that the thickness of the sheet is formed by numerous individual sweeps, some of which are successive sweeps from the same web and others which are from successive or preceding webs. To form a sheet product of a predetermined basis weight (weight per area of fabric), the rate of fiber production from each spin pack is maintained relatively constant and the conveyor speed is controlled to bring about the desired basis weight. However, it has been found that if every other spin station is shut down and the conveyor is run at one half the normal belt speed, the sheet is less porous than a sheet which was formed by all packs operating and the conveyor belt moving at full speed. It is believed that the two sheets having the same basis weight have the same number of sweeps forming the thickness of the sheet. However, the sweeps are from one half the number of webs. Thus, it is presumed that there must be some interaction between successive sweeps from the same web that is different than the interaction between sweeps of different webs that provides the resulting sheets with different porosity.

Several theories have been discussed for this phenomena. Presently, the most commonly accepted theory is that there is some type of tackiness of the web immediately after it is spun. The logical support for the theory is that there is a short time duration between the second sweep of a web laying down on a first sweep as compared to the time it takes for a sweep of the next successive web to come into contact with the preceding web. If there is a tackiness, then the webs are interacting or attaching to one another in a way that a higher Gurley Hill Porosity Value is attained in the bonded sheet. It perhaps should be noted that the Gurley Hill Porosity Value of the sheet product S is highest immediately after it has been formed in the spin cell. When the sheet product is bonded, the fibrils tend to shrink thereby opening up the sheet product and making it more porous. However, the sheet products formed with fewer web swaths (having the same basis 10 weight) maintain higher Gurley Hill Porosity Values after bonding. This phenomena has created complications for running tests in anticipation of large scale commercial manufacturing where the smaller scale test system is designed to manufacture with fewer numbers of web swaths.

As it is desirable for certain end uses to produce less permeable sheet product, then based on the above theory, the system would use fewer spin packs to make sheet products. However, fewer spin packs means lower productivity for the manufacturing system. Thus, to attain certain qualities, productivity must be compromised. It would be desirable to create webs that retain the believed tackiness for a little longer on the conveyor belt so as to obtain higher Gurley Hill Porosity Values while operating at the highest possible productivity.

Returning back to the discussion of the modified letdown chambers described earlier, it has been surmised that the webs produced by such configurations may retain some of the tackiness theorized to benefit Gurley Hill Porosity. In particular, the streaky portions of the webs are now believed to not be large fibrils, but actually are a collection of small fibrils collected together in a manner that hold a little of the spin agent therein retaining some tackiness for moments longer than other configurations. As such, the dynamics of the solution passing through the letdown chamber may be one key method of obtaining high Gurley Hill Porosity Values, In fact, Gurley Hill Porosity Values have been attained which are higher than that obtained by other comparable processes.

The dynamics are believed to center around the flow through the letdown chamber such that if smooth, continuous flow is established, the webs tend to be well fibrillated but have lower Gurley Hill Porosity. However, it is believed that not all the solution has the same residence time in the letdown chamber, but rather there are a range of residence times for the solution in the letdown chamber. In other words, some portions of the solution are believed to pass quickly through the letdown chamber while other portions of the solution move through the letdown chamber at a slower rate. With different configurations of the letdown chamber, the a range of residence times is broadened or narrowed. With the two thirds and one half inserts described above, the two phase solution undertakes a flow characteristic in the letdown chamber wherein a broader range of residence times is attained. Broader ranges of residence times is: believed to cause portions of the created web to have the tackiness which is also believed to create higher Gurley Hill Porosity Values in the sheet product. The term scale of recirculation is also used to mean range of residence times. For example, a higher scale of recirculation in the letdown chamber means that the solution has a broader range of residence in the letdown chamber. This is because there is believed to be zones within the letdown chamber where solution moves quickly therethrough and other portions where the solution lags and may even back up until other dynamic forces cause the solution to move toward and through the spin orifice. As yet there have been no test procedures developed to confirm that such dynamics are indeed occurring. However, based on the theory, it is believed that letdown chamber geometry which increases the scale of recirculation will provide the less porous sheet product. Examples of techniques to increase the scale of recirculation would be to reduce the length to diameter ratio of the letdown orifice, to increase the deceleration angle within the letdown chamber, or to otherwise slow portions of the flow of solution through the letdown chamber.

The following are a general discussion of the testing procedures to collect data for the samples:

Gurley Hill Test Method

The Gurley Hill test method is a measure of the barrier strength of the sheet material for gaseous materials. In particular, it is a measure of how long it takes for a volume of gas to pass through an area of material wherein a certain pressure gradient exists.

Gurley-Hill porosity is measured in accordance with TAPPI T-460 om-88 using a Lorentzen & Wettre Model 121D Densometer. This test measures the time of which 100 cubic centimeters of air is pushed through a one inch diameter sample under a pressure of approximately 4.9 inches of water. The result is expressed in seconds and is usually referred to as Gurley Seconds. ASTM refers to the American Society of Testing Materials and TAPPI refers to the Technical Association of Pulp and Paper Industry.

Tear

Tear strength means Elmendorf tear strength and is a measure of the force required to propagate a tear cut in the fabric. The average force required to continue a tongue-type tear in a sheet is determined by measuring the work done in tearing it through a fixed distance. The tester consists of a sector-shaped pendulum carrying a clamp which is in alignment with a fixed clamp when the pendulum is in the raised starting position, with maximum potential energy. The specimen is fastened in the clamps and the tear is started by a slit cut in the specimen between the clamps. The pendulum is then released and the specimen is torn as the moving jaw moves away from the fixed jaw. Elmendorf tear strength is measured in accordance with TAPPI-T-414 om-88 and ASTM D 1424.

Elongation to Break

Elongation to break of sheet is a measure of the amount a sheet stretches prior to failure (breaking)in a strip tensile test. A 1.0 inch (2.54 cm) wide sample is mounted in the clamps—set 5.0 inches (12.7 cm) apart—of a constant rate of extension tensile testing machine such as an Instron table model tester. A continuously increasing load is applied to the sample at a crosshead speed of 2.0 in/min (5.08 cm/min) until failure. The measurement is given in percentage of stretch prior to failure. The test generally follows ASTM D1682-64.

Pursuant to the aforementioned test procedures, data was collected on a number of samples to show the effects of the changes in the sheet product. All sheets were made by spinning 20% (by weight) polyethylene in n-pentane spin agent at 1500 psi pressure and 175° C. temperature in the letdown chamber with at feed rate through the letdown chamber of approximately one foot per second. The full size letdown chamber is approximately 4.58 inches is length and 0.615 inches in diameter. Thus, the length to diameter ratio is about 7.45 to one. The two thirds let down is 2.9 inches in length and the one half letdown is 2.68 inches in length while both have a diameter of 0.615 inches like the full length letdown chamber. The length to diameter ratios of the resulting letdown chambers is about 4.715 and 4.36 respectively. The spin cell was closed at a pressure of 3.55 inches (gage) of water and a temperature approximately 50 to 55° C. The sheet products were bonded in a Palmer bonder with saturated steam at 51 psi. The sheets are approximately 28 inches wide, about 1.7 oz./sq. yd. and made with six separate webs.

| Letdown Configuration | Porosity GH | Tear | Elongation | Web Fibrillation |
|---|---|---|---|---|
| Full | <36 | 1.9 | 19 | Good |
| Two Thirds | 45–60 | 1.5 | 15 | Poor |
| Half | >95 | 1.5 | 18 | Very Poor |

The foregoing description is intended to disclose and describe the invention and the preferred embodiments thereof. It is not intended to limit the invention or scope of protection provided by any patent granted on this application.

We claim:

1. A process for manufacturing spunbonded olefin webs made of layers of flash spun plexifilamentary film-fibril webs wherein the process comprises forming a single phase solution of olefin polymer with spin agent at high pressure and temperature, lowering the pressure of the solution in a letdown chamber to form a two phase solution, and directing the two phase solution through a plurality of spin orifices to flash evaporate the spin agent and form plexifilamentary film-fibril webs, overlaying the film-fibril webs on a conveyor to form nonwoven sheet material having properties in a predetermined range, the process including the step of inducing a higher scale of recirculation in the letdown chamber.

2. The process according to claim 1 wherein the step of inducing a higher scale of recirculation comprises altering the configuration of the letdown chamber by installing a letdown insert into the spin pack to reduce the length of the letdown chamber.

3. The process according to claim 2 wherein the step of altering the configuration does not include reducing the cross sectional area of the letdown chamber.

4. The process according to claim 1 wherein the step of inducing a higher scale of recirculation comprises altering the configuration of the letdown chamber comprises installing an insert into the spin pack which changes the angle of the deceleration wall of the letdown chamber.

5. A apparatus for flash spinning plexifilamentary webs including a spin cell, a spinpack within the cell for receiving spin solution at high pressure and temperature, means for holding the polymer solution at a letdown pressure lower than a cloud point pressure to enter a region of two phase separation, wherein the means for holding polymer at the letdown pressure includes an insert including a letdown orifice and wherein the system includes an assortment of such inserts wherein certain inserts will provide a different letdown chamber length than another of said assortment of inserts.

6. An apparatus according to claim 5 wherein at least two of the inserts in said assortment accommodate a generally planar orifice plate having the letdown orifice therein and the various inserts in the selection provide the accommodations for the orifice plate so as be a different distance from said spin orifice.

7. The apparatus according to claim 5 wherein each of said inserts further include a deceleration wall adjacent said planar orifice plate in the letdown chamber having a deceleration angle for the polymer to decelerate after passing through the letdown orifice, such that the assortment of inserts includes a variety of deceleration angle walls.

8. A process for manufacturing spunbonded olefin webs made of layers of flash spun plexifilamentary film-fibril webs wherein the process comprises forming a single phase solution of olefin polymer with spin agent at high pressure and temperature, lowering the pressure of the solution in a letdown chamber to form a two phase solution, and directing the two phase solution through a plurality of spin orifices to flash evaporate the spin agent and form plexifilamentary film-fibril webs, overlaying the film-fibril webs on a conveyor to form nonwoven sheet material having properties in a predetermined range, the process including the step of changing the properties of the sheet by altering the configuration of the letdown chamber thereby obtaining sheet material having altered properties.

9. The process according to claim 8 wherein the step of altering the configuration of the letdown chamber comprises installing a letdown insert into the spin pack to reduce the length of the letdown chamber.

10. The process according to claim 9 wherein the step of altering the configuration does not include reducing the cross sectional area of the letdown chamber.

11. The process according to claim 8 wherein the step of altering the configuration of the letdown chamber comprises installing an insert into the spin pack which changes the angle of the deceleration wall of the letdown chamber.

12. An apparatus flash spinning plexifilamentary webs including a spin cell, a spinpack within the cell for receiving spin solution at high pressure and temperature, a letdown chamber associated with the spin pack for holding the polymer solution at a letdown pressure lower than a cloud point pressure to enter a region of two phase separation, wherein the letdown chamber has a length to diameter ratio of less than five to one.

13. A process for flash spinning plexifilamentary webs comprising forming a single phase spin solution of polymer and spin agent at high pressure and temperature, reducing at least the pressure of the solution through a letdown orifice allowing the solution to form a two phase solution in a letdown chamber wherein the letdown chamber has a length to diameter ratio of less than five to one, and forming a plexifilamentary web by passing the two phase solution through a spin orifice.

* * * * *